US010072222B2

(12) United States Patent
Andersen et al.

(10) Patent No.: US 10,072,222 B2
(45) Date of Patent: Sep. 11, 2018

(54) PROCESS FOR CONVERSION OF A HYDROCARBON STREAM

(71) Applicant: Haldor Topsøe A/S, Kgs. Lyngby (DK)

(72) Inventors: Stefan Andersen, Albertslund (DK); Ole Frej Alkilde, Valby (DK)

(73) Assignee: Haldor Topsoe A/S, Lyngby (DK)

( * ) Notice: Subject to any disclaimer, the term of this patent is extended or adjusted under 35 U.S.C. 154(b) by 0 days.

(21) Appl. No.: 15/532,444

(22) PCT Filed: Dec. 16, 2015

(86) PCT No.: PCT/EP2015/079987
§ 371 (c)(1),
(2) Date: Jun. 1, 2017

(87) PCT Pub. No.: WO2016/096982
PCT Pub. Date: Jun. 23, 2016

(65) Prior Publication Data

US 2017/0267938 A1 Sep. 21, 2017

(30) Foreign Application Priority Data

Dec. 17, 2014 (DK) ..... 2014 00739

(51) Int. Cl.
*C10G 67/02* (2006.01)

(52) U.S. Cl.
CPC ..... *C10G 67/02* (2013.01); *C10G 2300/1055* (2013.01); *C10G 2300/1074* (2013.01);
(Continued)

(58) Field of Classification Search
CPC ..... C10G 67/02; C10G 2300/301; C10G 2300/1055; C10G 2300/1074;
(Continued)

(56) References Cited

U.S. PATENT DOCUMENTS 2,914,457 A 11/1959 Beavon
3,175,966 A 3/1965 Burch
(Continued)

FOREIGN PATENT DOCUMENTS

JP 58-7485 A 1/1983

OTHER PUBLICATIONS

G. Alfke et al., "Oil Refining, 3.1. Crude Oil Distillation" Ullmann's Encyclopedia of Industrial Chemistry, pp. 207-223, Jan. 15, 2007.

*Primary Examiner* — Brian A McCaig
(74) *Attorney, Agent, or Firm* — Blank Rome LLP

(57) ABSTRACT

In a broad aspect the present disclosure relates to a process plant and a process for upgrading a hydrocarbon mixture, withdrawn as a direct stream from a crude distillation unit and an initial boiling point below 200° C., and a fraction of at least 5% boiling above 500° C., 550° C. or 650° C. comprising the steps of a. directing said hydrocarbon mixture to a vacuum flasher unit, b. withdrawing a heavy hydrocarbon fraction from said vacuum flasher unit, c. withdrawing a light hydrocarbon mixture for hydrocrackingfrom said vacuum flasher unit, d. directing said light hydrocarbon mixture for hydrocracking and a stream rich in hydrogen to con-tact a material catalytically active in hydrocracking, e. withdrawing a hydrocracked stream of hydrocarbon from said hydrocracker. with the associated benefit of limiting the amount of asphaltenes, metals and other heavy components contacting said material catalytically active in hydrocracking.

14 Claims, 3 Drawing Sheets

Figure 1:
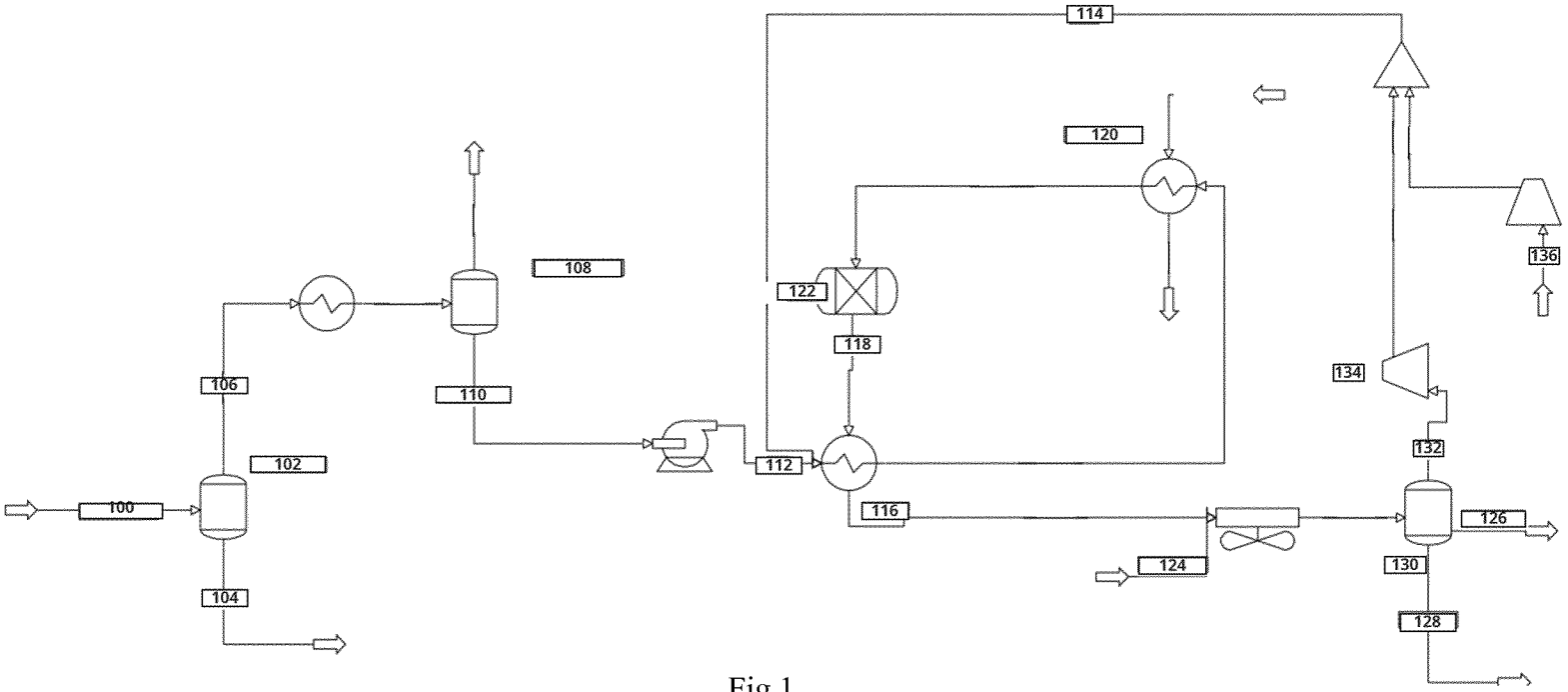

(52) U.S. Cl.
CPC ..... *C10G 2300/1077* (2013.01); *C10G 2300/301* (2013.01); *C10G 2300/4006* (2013.01); *C10G 2300/4012* (2013.01); *C10G 2400/04* (2013.01)

(58) Field of Classification Search
CPC .... C10G 2300/1077; C10G 2300/4006; C10G 2300/4012
See application file for complete search history.

(56) References Cited

U.S. PATENT DOCUMENTS

| | | | | |
|---|---|---|---|---|
| 4,092,238 | A | 5/1978 | Iona | |
| 4,148,759 | A | 4/1979 | Hilfman | |
| 4,717,468 | A | 1/1988 | Funk | |
| 4,902,405 | A * | 2/1990 | MacLean | C10G 65/10 208/100 |
| 6,280,606 | B1 * | 8/2001 | Morel | C10G 65/16 208/58 |
| 8,784,646 | B2 | 7/2014 | Sanchez et al. | |
| 2004/0050753 | A1 | 3/2004 | Marion et al. | |
| 2009/0288984 | A1 | 11/2009 | Colyar et al. | |
| 2010/0122932 | A1 | 5/2010 | Haizmann et al. | |

* cited by examiner

PROCESS FOR CONVERSION OF A HYDROCARBON STREAM

The invention relates to a process for upgrading a wide range of crude oil fractions to a middle distillate fraction.

For refineries having a moderate production volume it is common to reduce the complexity of the crude distillation unit, and thus to reduce the investment in fractionation equipment. However, as demonstrated by the present disclosure the proper selection of the streams to be upgraded may provide a more optimal balance between the capital cost, the operating cost and the operating income.

Traditionally a crude oil is separated into distillate fractions and a residue stream in a crude distillation unit. The residue stream comprising heavy hydrocarbons can be hydrotreated in a residue hydrotreater, in which heteroatoms are removed from the hydrocarbons, which thus are converted to fuel oil. The stream comprises some unreactive hydrocarbons which requires a high residence time to be hydrotreated, and thus the reactor required for such residue hydrotreatment becomes very large. Also traditionally, the residue stream can be further separated in a vacuum distillation unit into one or more vacuum gas oil streams (VGO) and a vacuum residue. The vacuum gas oil streams are then typically further processed in hydrocracking or fluid catalytic cracking units. Such a vacuum distillation unit has a high investment and operating cost and provides a high separation efficiency.

According to the present disclosure a process for conversion of a poorly separated stream comprising heavy hydrocarbons into middle distillate is proposed. The process receives a heavy feed as a direct draw from the crude distillation unit. By nature, such a direct draw from the crude distillation unit will consist of a wide range of materials, from which the heavy tail is separated by means of a vacuum flasher unit. The effect of using a vacuum flasher unit is that the least reactive hydrocarbons requiring a high residence time to be hydrotreated, and possibly hydrocracked are removed from the downstream reactions.

In the present context a crude distillation tower shall be construed as a distillation tower receiving crude oil, which may be pre-treated e.g. by desalting, and separating it according to boiling point by means of distillation. The typical crude distillation tower receives a feed stream at elevated temperatures. The receiving zone is called a flash zone where the feed is separated in a gas and liquid fraction to allow liquid product to flow down towards the bottom and gaseous product to drift upwards. At higher positions the temperature is lower, allowing selective condensation according to boiling point. The product withdrawn at various positions in the crude distillation tower (a direct draw) will be defined as having a boiling point corresponding to the temperature at that position, or lower. To provide a more specific fraction the gas of the direct draw is stripped off.

In the present context an overflash stream is a stream withdrawn as a direct draw above the flash zone of a crude distillation tower, which is directed to a lower position in the crude distillation tower. The gas in the overflash stream is not stripped off, and the overflash stream will often include entrained feed. Therefore the overflash stream will typically have a very broad boiling point range, typically from less than 200° C. to above 500° C., 550° C. or even 650° C.

In the present context a vacuum flasher unit may either be a simple flash drum separating two phases under sub-atmospheric pressure or it may be a more advanced separation tower operating under sub-atmospheric pressure and comprising multiple trays, packing or other specific separation aids, thus enabling separation in several product fractions, such as a diesel stream, a vacuum gasoil stream and a residual fraction.

In the present context the term fluid communication shall be construed as any substantial unhindered connection between two process elements, including but not limited to the connection via tubes, via the same side of heat exchangers, but excluding the connection through a catalyst filled reactor or means of separation.

In the present context the unit $Nm^3/m^3$ shall indicate the volume of gas (in normal cubic meters, i.e. cubic meters at 0° C. and 1 bar) per volume of liquid (in standard cubic meters, i.e. cubic meters at 15° C. and 1 bar).

As it is known to the skilled person a hydrocracker may be operated at high or low severity, which is defined by the combination of catalytically active material, temperature and pressure. At high severity a higher fraction of the feed is hydrocracked, and typically to lower hydrocarbon. The skilled person will be able to configure the operation of the hydrocarbon to a desire process outcome, e.g. the maximum boiling point of the product.

In a broad form the present disclosure relates to a process for upgrading a hydrocarbon mixture, withdrawn as a direct stream from a crude distillation unit and having an initial boiling point below 200° C., and a fraction of at least 5% boiling above 500° C., 550° C. or above 650° C. comprising the steps of a. directing said hydrocarbon mixture to a vacuum flasher unit,
b. withdrawing a heavy hydrocarbon fraction from said vacuum flasher unit,
c. withdrawing a light hydrocarbon mixture for hydrocracking from said vacuum flasher unit,
d. directing said light hydrocarbon mixture for hydrocracking and a stream rich in hydrogen to contact a material catalytically active in hydrocracking,
e. withdrawing a hydrocracked stream of hydrocarbon from said hydrocracker.

with the associated benefit of providing a stream for contacting said material catalytically active in hydrocracking with a limited amount of asphaltenes, metals and other heavy components. The provision of such a stream will also result in a relatively low consumption of hydrogen in the hydrocracker and moderate requirements to residence time and pressure during the hydrocracking reactions.

More specifically the hydrocarbon mixture, withdrawn as a direct stream from a crude distillation unit has a fraction boiling above 650° C. of at least 5% comprising the steps of a. directing said hydrocarbon mixture to a vacuum flasher unit,
b. withdrawing a heavy hydrocarbon fraction from said vacuum flasher unit,
c. withdrawing a light hydrocarbon mixture for hydrocracking from said vacuum flasher unit,
d. directing said light hydrocarbon mixture for hydrocracking and a stream rich in hydrogen to contact a material catalytically active in hydrocracking,
e. withdrawing a hydrocracked stream of hydrocarbon from said hydrocracker.

with the associated benefit of limiting the amount of asphaltenes, metals and other heavy components contacting said material catalytically active in hydrocracking.

In a further embodiment said hydrocarbon mixture is withdrawn as an overflash stream or a part of the overflash stream from the crude oil distillation unit with the associated benefit of an overflash stream being available as a stream already drawn from the crude distillation unit. Typically, the overflash stream is withdrawn and then returned to the distillation tower at another location to enhance the separation in the tower. According to the present disclosure either all or some of the overflash stream may be directed for further processing.

In a further embodiment the hydrocarbon mixture directed to said vacuum flasher unit has a temperature of at least 250° C., 300° C. or 380° C., with the associated benefit of this temperature being sufficiently high for directing a significant amount of the hydrocarbon mixture into the light hydrocarbon phase, directed to the material catalytically active in hydrocracking. Typically, the overflash stream is received hot from the crude distillation unit, and no further heating is required.

In a further embodiment the hydrocarbon mixture directed to said vacuum flasher unit has a temperature of less than 450° C., 420° C. or 400° C., with the associated benefit of this temperature being sufficiently low for separating the least reactive residual hydrocarbons from the hydrocarbon mixture for hydrocracking.

In a further embodiment the pressure of said vacuum flasher unit is below 60 kPa, 80 kPa or 90 kPa with the associated benefit of the low pressure allowing a significant amount of the hydrocarbon mixture into the light hydrocarbon phase, directed to the material catalytically active in hydrocracking.

In a further embodiment the pressure of said vacuum flasher unit is above 0.5 kPa, 2 kPa or 10 kPa with the associated benefit of separating the least reactive residual hydrocarbons from the hydrocarbon mixture for hydrocracking.

In a further embodiment the hydrocarbon mixture is directed to said vacuum flasher unit at substantially the temperature at which it was withdrawn, with the associated benefit of avoiding equipment for heating or cooling the stream, while maintaining control over the vacuum flasher unit through the pressure of that unit.

In a further embodiment the process comprises the steps of adding steam to said vacuum flashing unit or stripping the light hydrocarbon mixture, with the associated benefit of an improved separation of the overflash feed, and thus reducing the amount very light hydrocarbons in the light hydrocarbon mixture.

In a further embodiment the process further comprises the step of withdrawing a further hydrocarbon mixture of which at least 80% boils between 150° C. and 360° C. from said vacuum flasher unit, with the associated benefit of said stream being suitable for being combined with the hydrocracked stream of hydrocarbon to be used as a diesel fuel or a diesel component.

In a further embodiment the material catalytically active in hydrocracking comprising a metal component selected from Group VIII and/or VIB of the Periodic System and being supported on a carrier containing one or more oxides taken from the group consisting of alumina, silica, titania, silica-alumina, molecular sieves, zeolites, ZSM-11, ZSM-22, ZSM-23, ZSM-48, SAPO-5, SAPO-11, SAPO-31, SAPO-34, SAPO-41, MCM-41, zeolite Y, ZSM-5, and zeolite beta, with the associated benefit of such materials being highly active in hydrocracking.

In a further embodiment the reaction step in the presence of a material catalytically active in hydrocracking is carried out a temperature between 200° C. and 460° C., a pressure between 15 and 200 barg, a liquid hourly space velocity between 0.2 $hr^{-1}$ and 5 $hr^{-1}$, and a hydrogen to hydrocarbon ratio between 100 and 2000 $Nm^3/m^3$, with the associated benefit of such process conditions being highly active in hydrocracking In a further embodiment the hydrocracking is carried out under a severity ensuring less than 5% of the product boiling above 360° C., with the associated benefit of providing a product which fulfills ASTM D86 requirements to diesel after a simple removal of light ends by e.g. a diesel stripper.

A further aspect of the present invention relates to a process plant comprising a crude oil distillation column having an inlet, multiple distillation outlets, an overflash outlet and an overflash inlet, a vacuum flash unit having an inlet a gas outlet, a VGO outlet and a resid outlet and a hydrocracking reactor containing a material catalytically active in hydrocracking having an inlet and an outlet, said process plant being configured for directing a crude oil to the inlet of the distillation column, for said overflash outlet being configured for withdrawing a hydrocarbon mixture stream in fluid communication with the inlet of vacuum flash unit, the VGO outlet of said vacuum flash unit being in fluid communication with the inlet of the hydrocracking reactor, the inlet of said hydrocracking reactor being further in fluid communication with a hydrogen source and the outlet of said hydrocracking reactor being configured for withdrawal of a stream boiling in the diesel range or the naphtha range optionally for further processing, with the associated benefit of such a process plant being highly a cost effective configuration for increased fuel production.

In a further embodiment said vacuum flash unit comprises a means of separation aids such as column packing or trays, and further has a diesel fraction outlet, with the associated benefit of making it possible to direct the diesel fraction in the overflash stream around the hydrocracker to reduce the yield loss from hydrocracking.

FIG. 1 shows a process according to the present disclosure.

FIG. 1 shows one embodiment of the present disclosure, in which a stream from the crude oil distillation unit (100) is directed to a vacuum flash unit (102) from which a heavy bottoms (104) is withdrawn, which is dominated by the fraction boiling above 480° C. The overhead (106) fraction is directed to a surge drum (108) from which a hydrocracker feed (110) is directed to a hydrocracker section. The hydrocracker feed will be dominated by hydrocarbons containing only a small amount of residue boiling above 480° C., and thus only small amounts of metals and other heteroatoms which typically are present in the heavy fraction. The hydrocracker feed (112) is combined with a hydrogen rich stream (114) heated by feed effluent heat exchange (116) with the hydrocracked product (118) and in a further heat exchange (120), before being directed to the hydrocracking reactor (122). The product of the hydrocracker (118) is cooled in the feed effluent heat exchanger (116) and combined with washing water (124) before the product hydrocarbon mixture (126) is separated from the sour water (128) and the recycle gas (132) in a cold separator (130). The recycle gas (132) is pressurized (in 134) and combined with make up hydrogen (136) forming the hydrogen rich stream (114).

Figure 2:
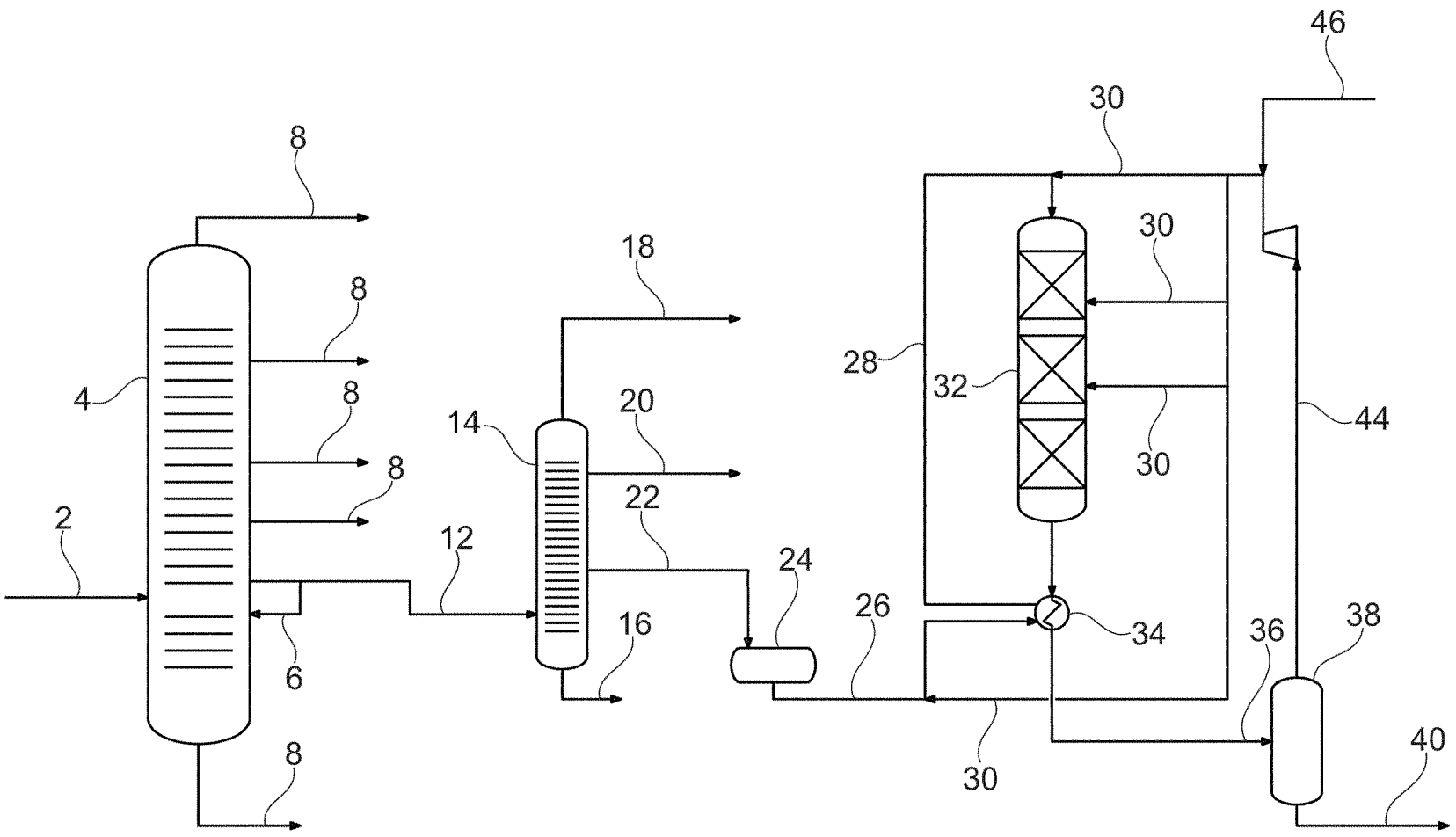

FIG. 2 shows a further embodiment of the present disclosure, in the form of a process in which a crude oil feedstock 2 is directed to crude oil distillation tower 4, which separates the feedstock into a number of products 8 based on boiling point. The crude oil distillation tower 4 is configured for withdrawal of an overflash stream 6 to enhance the separation by addition of the overflash to a lower column position. The overflash stream for conversion, which may be all or a part of the overflash stream 12 is directed to a vacuum flash unit 14 from which a heavy bottoms stream 16, a gas stream 18, a diesel stream 20 and a VGO stream 22 are withdrawn. The VGO stream 22 is directed as a hydrocracker feed 26 to a hydrocracking section optionally via a stripper, a surge drum 24 and a pre-heater 34. The hydrocracker feed 26 will be dominated by hydrocarbons boiling below 480° C., containing only a small amount of residue boiling above 480° C., and thus only small amounts of metals and other heteroatoms which typically are present in the heavy fraction, and which cause a high hydrogen consumption. The hydrocracker feed 26 is combined with a hydrogen rich stream 30 before and/or after heating the stream by feed effluent heat exchange with the hydrocracked product in heat exchanger 34 and in possibly further heated, before being directed to the hydrocracking reactor 32. The product of the hydrocracker is cooled in the feed effluent heat exchanger 34 and in a cooler (not shown) before the product hydrocarbon mixture 40 is separated from the recycle gas 44 in a cold separator 38. The recycle gas 44 is circulated and combined with make up hydrogen 46 forming the hydrogen rich stream 30. By configuration of the severity operating conditions of the hydrocracker, the extent of reaction may be defined such that the hydrocracker product fulfills the boiling point criteria for diesel, and thereby only a separator for removal of a light fraction of the product.

This configuration allows the severity of hydrocracking to be moderate, since residual hydrocarbons are not directed to hydrocracking. This has the benefit that metals and asphaltenes are not directed to hydrocracking, and thus cannot deactivate the catalytically active material. In addition a lower pressure and lower residence time (and thus a smaller reactor and a lower amount of catalytically active material) may be employed, which has significant cost savings. In addition, if the process is configured for bypassing a fraction such as the diesel fraction 20 the size of the hydrocracking reactor may be reduced further.

The configurations shown in FIG. 1 and FIG. 2 are optimized for diesel production, but as it will be evident to the skilled person, the operation of the hydrocracker may easily be altered for maximizing the production either of hydrocarbons boiling in the naphtha ranges or of hydrocarbons for a lubricantbas oil. In these cases the diesel stream 20 withdrawn from the vacuum flasher unit according to FIG. 2 may be omitted, it may be directed to a diesel unit, or alternatively the vacuum flasher unit may be configured for this lighter hydrocarbon stream to be boiling in the desired range.

Figure 3:
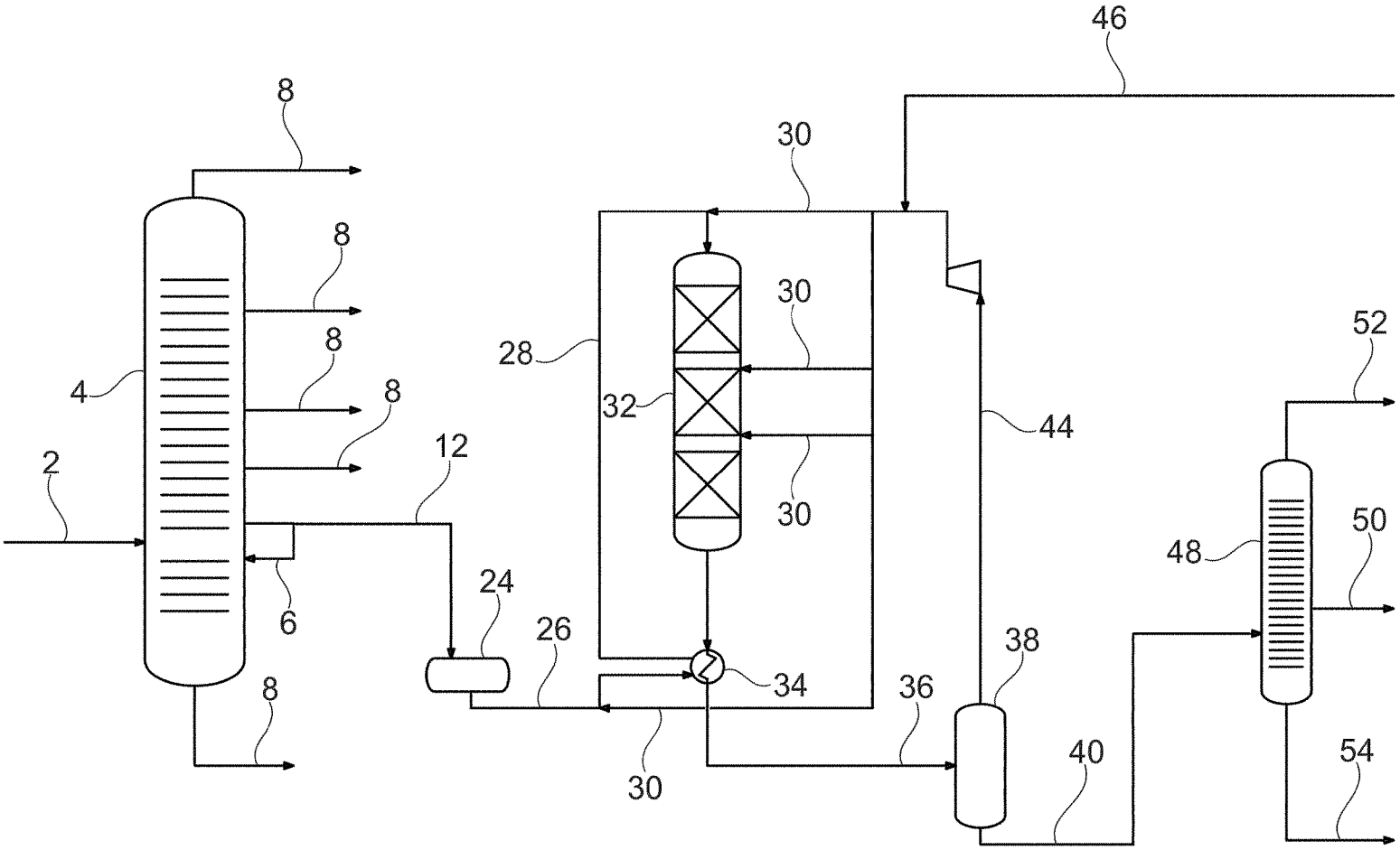

FIG. 3 shows an equivalent process according to the prior art. Here a crude oil feedstock 2 is directed to crude oil distillation tower 4, which separates the feedstock into a number of products 8 based on boiling point. The crude oil distillation tower 4 is configured for withdrawal of an overflash stream 6 to enhance the separation by addition of the overflash to a lower column position. The overflash stream for conversion, which may be all or a part of the overflash stream 12 of the crude oil distillation column is directed via a surge drum 24 as a hydrocracker feed 26 to a hydrocracker reactor 32, together with a hydrogen stream 30. The hydrocracked product 36 is separated in a cold separator 38 from which the light stream forms a recycle gas 44, which is combined with a make up hydrogen stream 46, and a stream of liquid hydrocarbon feed 26. The heavy stream 40 from the separator 38 is directed to a fractionator 48 from which a light fraction 52, diesel 50 and unconverted oil 54 may be withdrawn.

While it appears advantageous to avoid the cost of the vacuum flasher unit, the configuration of FIG. 3 has the draw back relative to the configuration of FIG. 2 of a larger hydrocracking reactor, which due to the presence of residual hydrocarbons is required to work under more severe conditions. In addition it will not be realistic to operate the hydrocracking process to a maximum boiling point due to the heavy end of the feed, and therefore a more complex fractionation is required. Finally the more severe conditions will result in a higher yield loss of intermediately boiling hydrocarbons, such as diesel components.

EXAMPLES

In the following an example of processing an overflash stream according to one embodiment of the present disclosure an example of processing an overflash stream according to the prior art are given.

The feed studied in the two examples is shown in Table 1. It is an overflash stream, which is immediately available from the crude distillation tower, and which has a very broad boiling point range, as determined by simulated distillation according to ASTM 7500. The reason for the broad boiling point range is an entrainment of heavy hydrocarbons from the crude feed and that the light components were not stripped from the product.

TABLE 1

| Mass % | Temperature [° C.] |
|---|---|
| IBP (SimDis 1%) | 160 |
| 5 | 290 |
| 10 | 320 |
| 20 | 360 |
| 30 | 380 |
| 40 | 395 |
| 50 | 405 |
| 60 | 415 |
| 70 | 450 |
| 80 | 490 |
| 90 | 530 |
| 95 | 600 |
| EP (SimDis 99%) | 710 |

Example 1

In a first example according to the present disclosure, shown in Table 2, corresponding to FIG. 2, an overflash stream is directed to a vacuum flasher, separating the inlet in a diesel fraction, a VGO fraction and a residual fraction. The VGO fraction is directed to the hydrocracker process, which is operated under a severity such that all VGO is hydrocracked to form diesel or lighter products, resulting in a total of 82022 kg/h diesel production withdrawn from the vacuum flasher in stream 28 or the hydrocracker after separation in stream 40.

The diesel yield, hydrogen consumption and equipment cost of Example 1 are defined as index 100.

Example 2

A second example according to the prior art, corresponding to FIG. 3, is also shown in Table 2. Here the overflash stream is not separated further prior to hydrocracking. The hydrocracking process was designed according to a limitation of constant hydrogen consumption, relative to Example 1, which results in the feed capacity being only 41% of the feed to Example 1, since the hydrocracking of heavy resid results in a high consumption of hydrogen. In addition the volume of the hydrocracker reactor and the amount of catalyst required are increased, and the requirements to equipment due to the elevated pressure will also be higher. The fractionator required to separate the products will also be more complex and energy intensive than the vacuum flasher required to split the feed in Example 1. All in all the equipment cost is estimated as 133% relative to example 1.

Example 2 results in only 50% diesel yield at the same hydrogen consumption, and at 133% the equipment cost. Had further hydrogen been available, it would have been possible to increase the diesel yield, but the hydrogen consumption and the equipment cost would have increased significantly.

It is therefore clear from the two examples that even though the overflash stream had undergone some separation before being withdrawn from the crude distillation column, the benefit from further separating the overflash in a vacuum flash unit is significant and clearly justifies the extra cost of the vacuum flash unit.

TABLE 2

| | | Example 1 Vacuum tower | Example 2 Overflash directly to hydrocracker |
|---|---|---|---|
| Overflash feed | kg/h | 179892 | 74108 |
| Diesel fraction from vacuum flasher | kg/h | 45940 | |
| Volume to hydrocracker | kg/h | 56153 | 74108 |
| Total diesel production | kg/h | 82022 | 40802 |
| Hydrocracker p (start of run) | atm | 140 | 175 |
| Diesel | Index | 100 | 50 |
| Hydrogen consumption | Index | 100 | 100 |
| Cost | Index | 100 | 133 |
| Cycle length | years | 2 | 2 |

The invention claimed is:

1. A process for upgrading a hydrocarbon mixture, withdrawn as a direct stream from a crude distillation unit and having an initial boiling point below 200° C., and a fraction of at least 5 mass % boiling above 500° C., comprising the steps of a. directing said hydrocarbon mixture to a vacuum flasher unit, b. withdrawing a heavy bottoms fraction from said vacuum flasher unit, c. withdrawing an overhead fraction for hydrocracking from said vacuum flasher unit, d. directing said overhead fraction for hydrocracking and a stream rich in hydrogen to a reaction step to contact a material catalytically active in hydrocracking, and e. withdrawing a hydrocracked stream of hydrocarbon from said hydrocracker.

2. A process according to claim 1 in which said hydrocarbon mixture is withdrawn as an overflash stream or a part of an overflash stream from a crude oil distillation unit.

3. A process according to claim 1, in which the hydrocarbon mixture directed to said vacuum flasher unit has a temperature of at least 250° C.

4. A process according to claim 1, in which the hydrocarbon mixture directed to said vacuum flasher unit has a temperature of less than 450° C.

5. A process according to claim 1, in which pressure of said vacuum flasher unit is below 90 kPa.

6. A process according to claim 1, in which pressure of said vacuum flasher unit is above 0.5 kPa.

7. A process according to claim 1, in which the hydrocarbon mixture is directed to said vacuum flasher unit at substantially the same temperature at which it was withdrawn from the crude distillation unit.

8. A process according to claim 1, further comprising the steps of adding steam to said vacuum flashing unit or stripping the overhead fraction.

9. A process according to claim 1, further comprising the step of withdrawing a hydrocarbon mixture of which at least 80% boils between 150° C. and 360° C. from said vacuum flasher unit.

10. A process according to claim 1, in which the material catalytically active in hydrocracking comprising a metal component selected from Group VIII and/or VIB of the Periodic System and being supported on a carrier containing one or more oxides taken from the group consisting of alumina, silica, titania, silica-alumina, molecular sieves, zeolites, ZSM-11, ZSM-22, ZSM-23, ZSM-48, SAPO-5, SAPO-11, SAPO-31, SAPO-34, SAPO-41, MCM-41, zeolite Y, ZSM-5, and zeolite beta.

11. A process according to claim 1, in which the reaction step in the presence of a material catalytically active in hydrocracking is carried out a temperature between 200° C. and 400° C., a pressure between 15 and 200 barg, a liquid hourly space velocity between 0.2 $hr^{-1}$ and 5 $hr^{-1}$, and a hydrogen to hydrocarbon ratio between 100 and 2000 $Nm^3/m^3$.

12. A process according to claim 11 in which the reaction step is carried out under a severity ensuring less than 5% of the product boiling above 360° C.

13. A process plant comprising a crude oil distillation column having an inlet, multiple distillation outlets, an overflash outlet and an overflash inlet, a vacuum flash unit having an inlet, a gas outlet, an overhead fraction outlet and a residual bottoms outlet and a hydrocracking reactor having an inlet and an outlet, and containing a material catalytically active in hydrocracking, said process plant being configured for directing a crude oil to the inlet of the distillation column, for said overflash outlet being in fluid communication with the inlet of the vacuum flash unit, the overhead fraction outlet of said vacuum flash unit being in fluid communication with the inlet of the hydrocracking reactor, the inlet of said hydrocracking reactor being further in fluid communication with a hydrogen source and the outlet of said hydrocracking reactor being configured for withdrawal of a stream boiling in the diesel range optionally for further processing.

14. A process plant according to claim 12 in which said vacuum flash unit further comprises column packing or trays, and has at least one further hydrocarbon fraction outlet, said further hydrocarbon outlet is above the overhead fraction outlet.

* * * * *